US006332402B1

(12) United States Patent
Weise et al.

(10) Patent No.: US 6,332,402 B1
(45) **Date of Patent: *Dec. 25, 2001**

(54) AMMUNITION CARTRIDGE WITH ELECTRIC PROPELLANT IGNITION

(75) Inventors: Thomas Weise; Hans Karl Haak, both of Unterlüss (DE)

(73) Assignee: TZN Forschungs—und Entwicklungszentrum Unterlüss GmbH, Unterlüss (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/567,585

(22) Filed: May 10, 2000

(30) Foreign Application Priority Data

May 10, 1999 (DE) ..... 199 21 379
Aug. 4, 1999 (DE) ..... 199 36 650

(51) Int. Cl.[7] ..... F42B 5/08

(52) U.S. Cl. ..... 102/472; 102/499; 102/202.5; 102/202.9

(58) Field of Search ..... 102/472, 499, 102/202.5, 202.9, 202.18; 89/28.05

(56) References Cited

U.S. PATENT DOCUMENTS

| | | | | |
|---|---|---|---|---|
| 319,628 | * | 6/1885 | Russell . | |
| 5,044,278 | * | 9/1991 | Campbell | 102/202.8 |
| 5,227,577 | * | 7/1993 | Eich et al. | 89/28.05 |
| 5,231,242 | * | 7/1993 | Chryssomallis et al. | 89/8 |
| 5,235,129 | * | 8/1993 | Corney | 102/472 |
| 5,241,909 | | 9/1993 | Eches et al. . | |
| 5,355,764 | * | 10/1994 | Marinos et al. | 89/8 |
| 5,503,081 | * | 4/1996 | Lindblom et al. | 102/472 |
| 5,549,046 | * | 8/1996 | Widner et al. | 102/202.7 |
| 5,945,623 | * | 8/1999 | Goldstein et al. | 89/8 |
| 6,186,040 | * | 2/2001 | Weise et al. | 89/8 |
| 6,247,411 | * | 6/2001 | Vornfett | 102/472 |
| 6,247,412 | * | 6/2001 | Vornfett | 102/472 |

FOREIGN PATENT DOCUMENTS

| | | | |
|---|---|---|---|
| 1 910 665 | 9/1970 | (DE) . | |
| 26 44 568 | 4/1978 | (DE) | F42B/3/12 |
| 34 41 117 | 5/1986 | (DE) | F42C/11/00 |
| 36 06 364 | 9/1987 | (DE) | F42C/19/12 |
| 37 31 074 | 3/1990 | (DE) | F42C/11/00 |
| 2 326 701 | 12/1998 | (GB) . | |
| 2 343 500 | 5/2000 | (GB) . | |

* cited by examiner

*Primary Examiner*—Charles T. Jordan
*Assistant Examiner*—Kimberly S Smith
(74) *Attorney, Agent, or Firm*—Venable; Gabor J. Kelemen

(57) ABSTRACT

An ammunition cartridge with electric propellant ignition includes a case having a rearward end closed by a case bottom and a front end; a propellant powder charge contained in the case; a high-voltage electrode disposed at the case bottom and having an end situated within the case; at least three tubes composed of propellant powder and extending from the electrode end toward the front end of the case through the propellant powder charge; an electric conductor extending in each tube and having opposite first and second ends; and an electric contact arrangement situated within the case in the front end thereof. The electric contact arrangement is electrically connected to the second end of the conductors and has externally exposed contact locations connectable to an electrically conducting component externally of the case. The first end of each electric conductor is electrically connected to the electrode.

10 Claims, 2 Drawing Sheets

AMMUNITION CARTRIDGE WITH ELECTRIC PROPELLANT IGNITION

CROSS REFERENCE TO RELATED APPLICATION

This application claims the priority of German Application Nos. 199 21 379.8 filed May 10, 1999 and 199 36 650.0 filed Aug. 4, 1999, which are incorporated herein by reference.

BACKGROUND OF THE INVENTION

This invention relates to an ammunition cartridge having an electrothermal ignition device for the propellant.

For igniting the propellant powder in known ammunition cartridges having an electrothermal igniting device, in the bottom region of the cartridge a wire conductor is supplied with a current of such an intensity that the wire vaporizes explosively and produces a high-energy arc which, in turn, ignites propellant powder.

It has been found to be disadvantageous in ammunition cartridges of the above-outlined type that by generating the bottom-side arc, first only a relatively small percentage of the propellant powder is ignited and, particularly in case of propellant powders which ignite only with difficulty (LOVA), frequently no reproducible combustion behavior of the propellant powder can be obtained.

SUMMARY OF THE INVENTION

It is an object of the invention to provide an ammunition cartridge of the above-outlined type in which even propellant powders which are ignitable only with difficulty and which are packed with high density have a reproducible combustion behavior without adversely affecting the performance and/or the high-voltage resistance of the cartridge.

This object and others to become apparent as the specification progresses, are accomplished by the invention, according to which, briefly stated, the ammunition cartridge with electric propellant ignition includes a case having a rearward end closed by a case bottom and a front end; a propellant powder charge contained in the case; a high-voltage electrode disposed at the case bottom and having an end situated within the case; at least three tubes composed of propellant powder and extending from the electrode end toward the front end of the case through the propellant powder charge; an electric conductor extending in each tube and having opposite first and second ends; and an electric contact arrangement situated within the case in the front end thereof. The electric contact arrangement is electrically connected to the second end of the conductors and has externally exposed contact locations connectable to an electrically conducting component externally of the case. The first end of each electric conductor is electrically connected to the electrode.

Essentially, it is the principle of the invention to provide special, axially extending ignition channels which pass through the propellant powder which fills the case. The ignition channels are constituted by the inner passage of the propellant tubes. An electric conductor, such as a wire or an electrically conducting inner coating passes through each propellant tube and is connected with the high-voltage electrode.

Upon connecting the high-voltage electrode with a current source, the wires disposed in the propellant powder tubes or the metallized inner layer of the tubes abruptly vaporize and generate an arc plasma canal within each tube. The current then flows through the plasma canals and high energy is transmitted to the environment of the electric conductors by way of radiation. Such an energy transfer leads to a rapid ignition of the propellant tubes and results in their fragmentation. The burning fragments of the propellant tubes as well as the released arc radiation cause a rapid and uniform ignition of the propellant powder.

Advantageously, the propellant powder tubes have radial openings to enhance a rapid transfer of energy to and ignition of the surrounding powder bed.

According to an advantageous embodiment of the invention, at least three ignition channels are provided, and the high-voltage electrode forms a current distributor at its end oriented toward the inside of the case.

DESCRIPTION OF THE PREFERRED EMBODIMENTS

Figure 1:
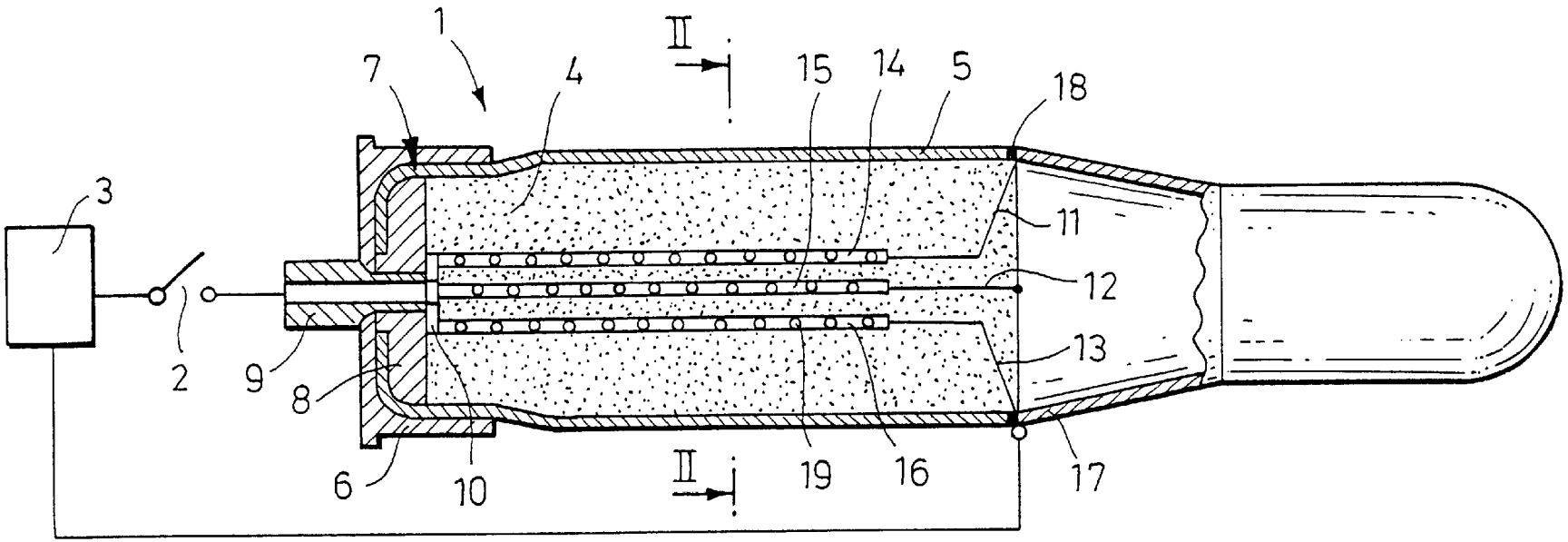
FIG. 1 is an axial sectional view of a preferred embodiment of the invention having three ignition channels.

FIG. 1 shows a large-caliber ammunition cartridge 1, for example, a tank gun ammunition which, for igniting the propellant, is connected to an energy source 3 by means of a switch 2. The weapon in which the ammunition cartridge is positioned is not illustrated for the sake of clarity.

The ammunition cartridge 1 includes a case 5 filled with propellant powder 4. The case 5 is made of a combustible material and has at its rearward end a metal case bottom 6. The combustible case is, in the region of its rearward end 7 clamped between a shaped insulating part 8 and the case bottom 6.

An electrically insulated high-voltage electrode 9 passes through the case bottom 6 and the insulating part 8 and is connected with a metal current distributor disk 10.

Figure 2:
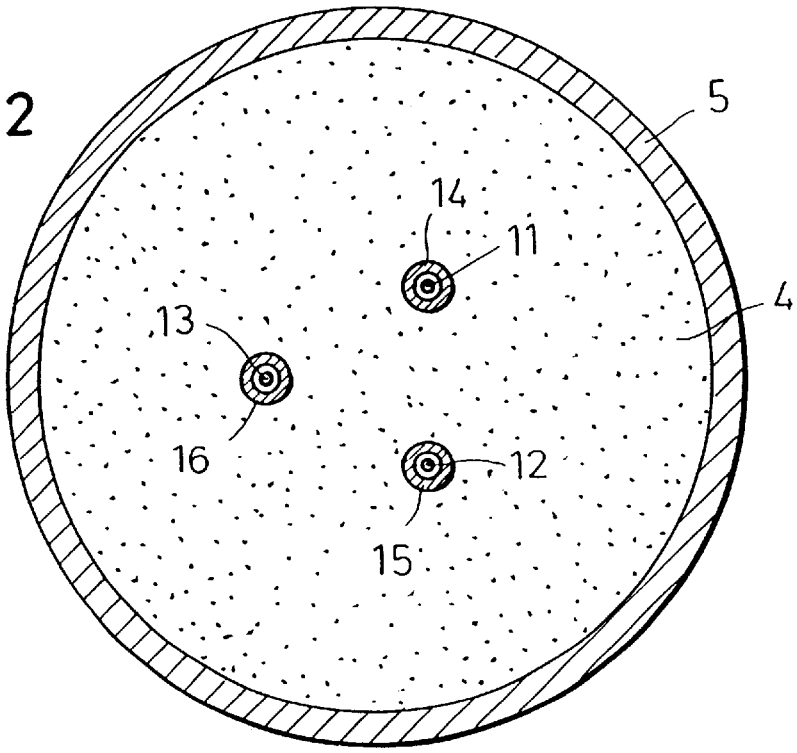
FIG. 2 is an enlarged sectional view taken along line II—II of FIG. 1.

Also referring to FIG. 2, three electric wires 11, 12 and 13 secured to the current distributor 10, pass axially through tubes 14, 15 and 16 and are, in the region of the case lid 17 of the propellant case 5, connected with an annular contact part 18. The tubes 14, 15 and 16 are composed of propellant powder. The contact part 18, in turn, is grounded by contacting the inner wall of the non-illustrated weapon barrel.

The propellant powder tubes 14, 15 and 16 are each provided with a plurality of radial apertures 19 which are axially and circumferentially distributed.

For firing the cartridge 1 the switch 2 is closed and the energy source delivering a voltage of up to 40 kV and containing a series of charged condensers is abruptly discharged. The resulting discharging current causes an electric explosion of the wires 11, 12 and 13, resulting in arc discharges within the propellant tubes 14, 15 and 16. The tubes are ignited by the arcs and are caused to burst. The burning and flying fragments of the tubes 14, 15 and 16 as well as the released arc radiation cause a rapid and uniform ignition and combustion of the propellant powder 4, together with the case 5 accommodating the propellant powder 4.

Figure 3:
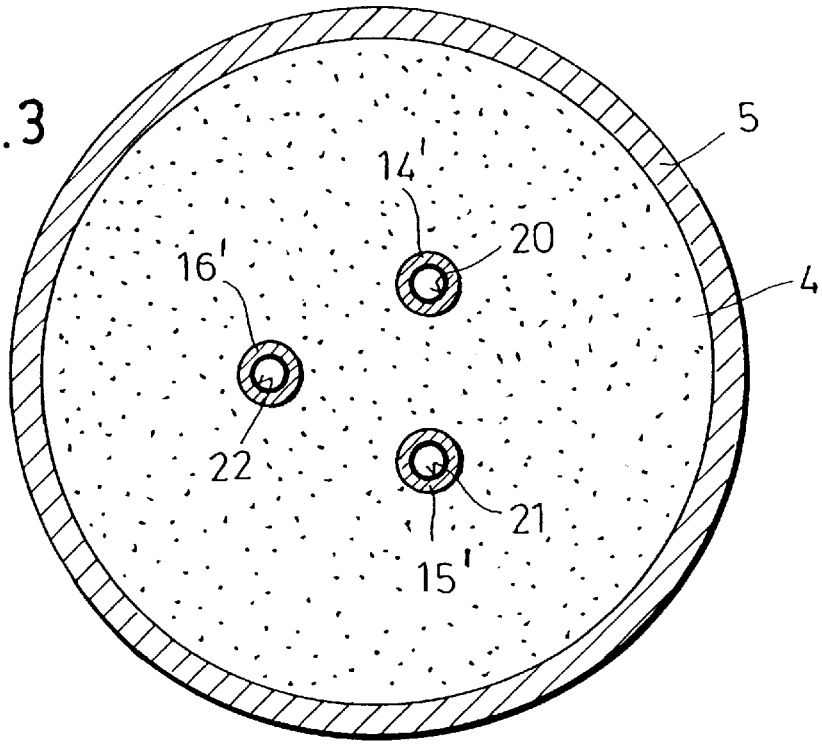
FIG. 3 is a view similar to FIG. 2, illustrating a further preferred embodiment of the cartridge according to the invention.

FIG. 3 shows an embodiment of the invention in which, instead of the wires 11–13 of the earlier described embodiment, electrically conducting layers 20, 21 and 22 are provided on the inside face of the respective propellant powder tubes 14', 15' and 16'. The layers 20, 21 and 22 are connected with the current distributor 10 and, by means of wires, with the contact portion 18.

It will be understood that the above description of the present invention is susceptible to various modifications, changes and adaptations, and the same are intended to be comprehended within the meaning and range of equivalents of the appended claims.

What is claimed is:

1. An ammunition cartridge with electric propellant ignition comprising (a) a case having a rearward end closed by a case bottom and a front end;

(b) a propellant powder charge contained in said case;

(c) a high-voltage electrode disposed at said case bottom and having an end situated within said case;

(d) at least three tubes composed of propellant powder and extending from said end of said electrode toward said front end of said case through said propellant powder charge;

(e) an electric conductor extending in each said tube and having opposite first and second ends;

(f) an electric contact arrangement situated within said case in said front end thereof; said electric contact arrangement being electrically connected to said second end of said conductors and having externally exposed contact locations being connectable to an electrically conducting component externally of said case; and (g) means for electrically connecting said first end of each said electric conductor to said electrode.

2. The ammunition cartridge as defined in claim 1, wherein at least some of the electric conductors are conductor wires passing through respective said tubes.

3. The ammunition cartridge as defined in claim 1, wherein at least some of the electric conductors are constituted by an electrically conducting coating carried on an inside surface of respective said tubes; each said coating having a first end electrically connected to said electrode and an opposite, second end electrically connected to said electric contact arrangement.

4. The ammunition cartridge as defined in claim 1, wherein said tubes are supported on said electrode.

5. The ammunition cartridge as defined in claim 1, wherein each tube has a length and a circumference; further wherein each tube has a plurality of apertures distributed circumferentially and along the tube lengths.

6. The ammunition cartridge as defined in claim 1, wherein said end of said electrode comprises a current distributor.

7. The ammunition cartridge as defined in claim 6, wherein said current distributor comprises a metal disk.

8. The ammunition cartridge as defined in claim 1, further comprising a lid closing said front end of said case and further wherein said contact arrangement is situated in a region of said lid.

9. The ammunition cartridge as defined in claim 1, wherein said contact arrangement comprises a contact ring.

10. The ammunition cartridge as defined in claim 1, wherein said case is combustible.

* * * * *